US007935903B2

(12) United States Patent
Niedzielski et al.

(10) Patent No.: US 7,935,903 B2
(45) Date of Patent: May 3, 2011

(54) VISIBLY ENHANCED CAREGIVER CALL DEVICE

(75) Inventors: Paul Niedzielski, Kimball, MN (US); Mark Sowada, Montrose, MN (US)

(73) Assignee: Crest Electronics Inc., Dassel, MN (US)

( * ) Notice: Subject to any disclaimer, the term of this patent is extended or adjusted under 35 U.S.C. 154(b) by 1265 days.

(21) Appl. No.: 11/500,839

(22) Filed: Aug. 8, 2006

(65) Prior Publication Data

US 2008/0063151 A1 Mar. 13, 2008

(51) Int. Cl.
*H01H 9/02* (2006.01)

(52) U.S. Cl. ..... 200/298; 200/308; 200/317

(58) Field of Classification Search ..... 200/298, 200/308, 310, 299
See application file for complete search history.

(56) References Cited

U.S. PATENT DOCUMENTS

| | | | | |
|---|---|---|---|---|
| 2,420,768 | A * | 5/1947 | Beveridge, Jr. | 200/4 |
| 2,436,518 | A * | 2/1948 | Lieffers et al. | 200/52 R |
| 6,416,196 | B1 * | 7/2002 | Lemarchand et al. | 362/84 |
| 6,514,460 | B1 * | 2/2003 | Fendrock | 422/55 |
| 6,911,609 | B2 * | 6/2005 | Miyauchi et al. | 200/43.17 |
| 7,073,916 | B2 * | 7/2006 | Yin et al. | 362/84 |
| 7,146,701 | B2 * | 12/2006 | Mahoney et al. | 29/458 |

* cited by examiner

*Primary Examiner* — Renee Luebke
*Assistant Examiner* — Lisa Klaus
(74) *Attorney, Agent, or Firm* — Westman, Champlin & Kelly, P.A.

(57) ABSTRACT

A call button device includes an electrical connector in electrical communication with an elongated electrical conductor. Also included is a cable housing at least a portion of the elongated conductor. Finally, the device includes a pendant member having an actuable switch that is in electrical communication with the electrical connector through the elongated conductor. The pendant member also includes a luminous portion configured to provide non-electrical illumination in a low light environment.

20 Claims, 5 Drawing Sheets

VISIBLY ENHANCED CAREGIVER CALL DEVICE

BACKGROUND

It is not uncommon for those receiving healthcare to spend periods of time isolated from their caregivers, especially during nighttime hours. Further, it is not uncommon for these periods of isolation to occur in a relatively dark environment. In a low or no light environment, it becomes convenient, if not medically important, for persons to be able to quickly detect articles within their space.

Many hospitals, nursing homes, home healthcare systems and the like implement electrical paging systems that enable persons under care to activate a call signal when assistance is required. When the call signal is activated, a corresponding audio and/or visual signal is communicated to the responsible caregivers. It is certainly desirable for persons under care to be able to quickly detect a device for activating the call signal. It can be difficult to detect such devices in a low or no light environment.

SUMMARY

A call button device includes an electrical connector in electrical communication with an elongated electrical conductor. Also included is a cable housing at least a portion of the elongated conductor. Finally, the device includes a pendant member having an actuable switch that is in electrical communication with the electrical connector through the elongated conductor. The pendant member also includes a luminous portion configured to provide non-electrical illumination in a low light environment.

DETAILED DESCRIPTION

At times, it may be difficult for a person under care to locate items within a low or no light environment. If an item is difficult to locate, the person may become frustrated and/or the standard of care may be compromised. For example, if a call button is not easy to locate, a patient may be unable or unwilling to request help from their caregiver. This can lead to undesirable consequences. For example, not requesting assistance for nocturnal urination is a known contributor to falls in the elderly.

Figure 1:
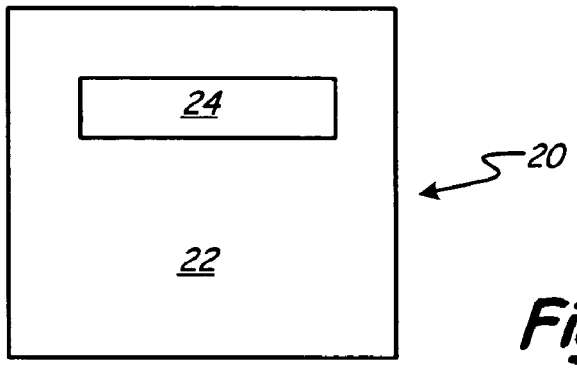
FIG. 1 is a schematic block representation of a healthcare device.

FIG. 1 is a schematic representation of a healthcare device 20. Device 20 can be any device or item that might be desirable to be seen in low or no light environments. Device 20 has an exterior surface 22. A portion 24 of the exterior surface 22 includes a luminous material capable of absorbing energy during lighted conditions and emitting a luminous intensity during low light conditions.

In one embodiment, device 20 is a call button assembly for an electrical alert system. In other embodiments, however, device 20 can be, without limitation, a pillow speaker, a light switch, a pull cord pendant, a water glass, a remote control device, a door handle cover, a bed rail, a dummy plug for electrical connections (including but not limited to a wall plug), a wheel chair component (including but not limited to a brake lever), a walker handle, a bed control, signage, and a name plate. Those skilled in the art will appreciate that these and other devices should be considered within the scope of the present invention.

Figure 2:
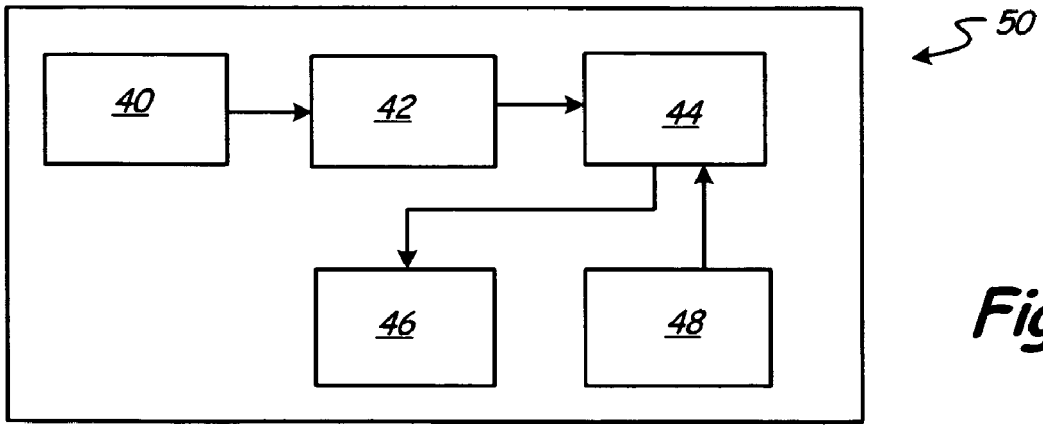
FIG. 2 is schematic block representation of a call system.

FIG. 2 is a schematic block diagram of a call system 50. A call button device 40 is attached to an interface 42. Upon activation of device 40, an electrical signal is provided from the device to an alert system 44. Alert system 44 illustratively includes a signal device 46 for alerting caregivers that the patient who actuated the call button device 40 is requesting assistance. Depending on system configuration and/or preferences, the signal device 46 may remain in an alerting state until a call station component 48 is actuated so as to cause the alert system 44 to reset the signal device 46. The signal device 46 can be, but is certainly not limited to, a lighted and/or audible indicator.

Figure 3:
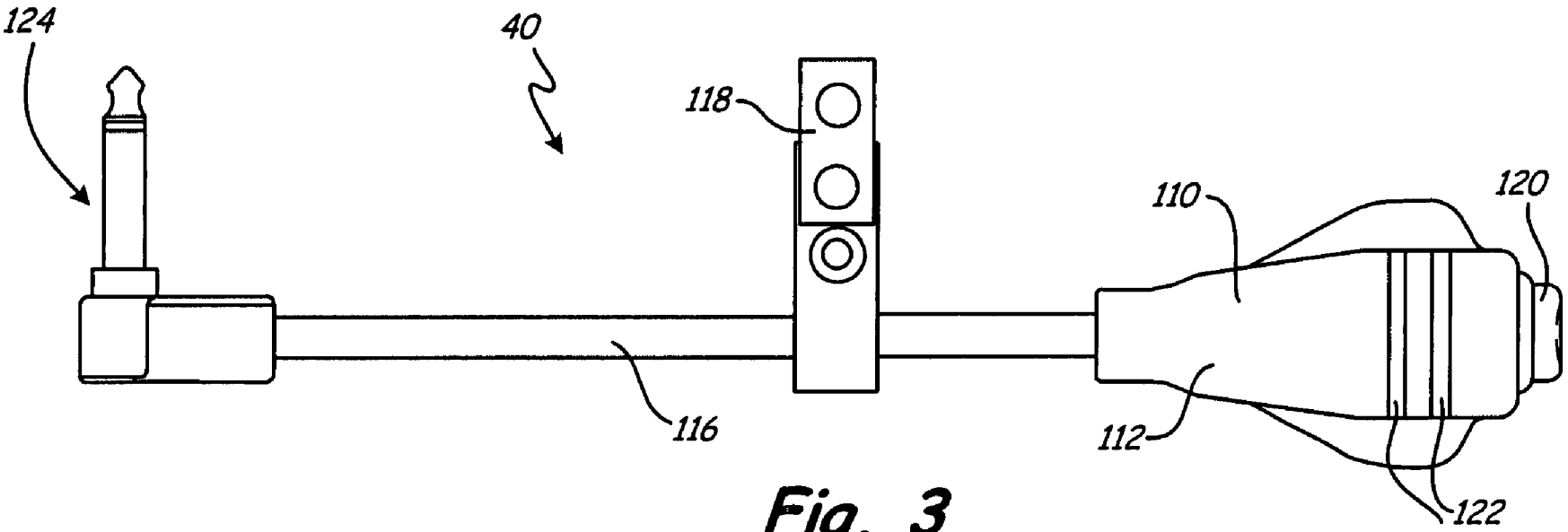
FIG. 3 is a side view of a call button device having a pendant portion.

FIG. 3 is a side view of a call button device 40 having a pendant portion 110. Pendant portion 110 has an exterior surface 112. A call switch 120 extends from an end of pendant 110. A pair of illumination bands 122 cross surface 112 and are, as will be described in greater detail below, configured to provide some level of illumination in a low-light or dark environment.

A cable 116 extends between an electrical plug 124 and pendant 110. Cable 116 illustratively houses a plurality of elongated conductors 108 (shown in FIG. 4) that electrically connect the call button 120 to plug 124. Electrical plug 124 is adapted to interface, for example, alert system 44 (shown in FIG. 2). Actuation and deactivation of call button 120 causes corresponding electrical signals to be communicated through the conductors within cable 116 and through plug 124. An optional clip 118 is releasably connected to cable 116 to allow the call button device 40 to be attached, for example, to a blanket, clothes, or a bed.

In one embodiment, the pair of illumination bands 122 extend radially around all or a portion of the diameter of pendant 110. Those skilled in the art will appreciate that any portion of pendant 110 may be equipped with the same or similar illuminative or luminous material. For example, the entire pendant 110 may be made of luminous material. Alternatively, any pattern, shape or size of luminous material portions other than the illustrated bands 122 may be employed anywhere on pendant 110 without departing from the scope of the present invention.

Figure 4:
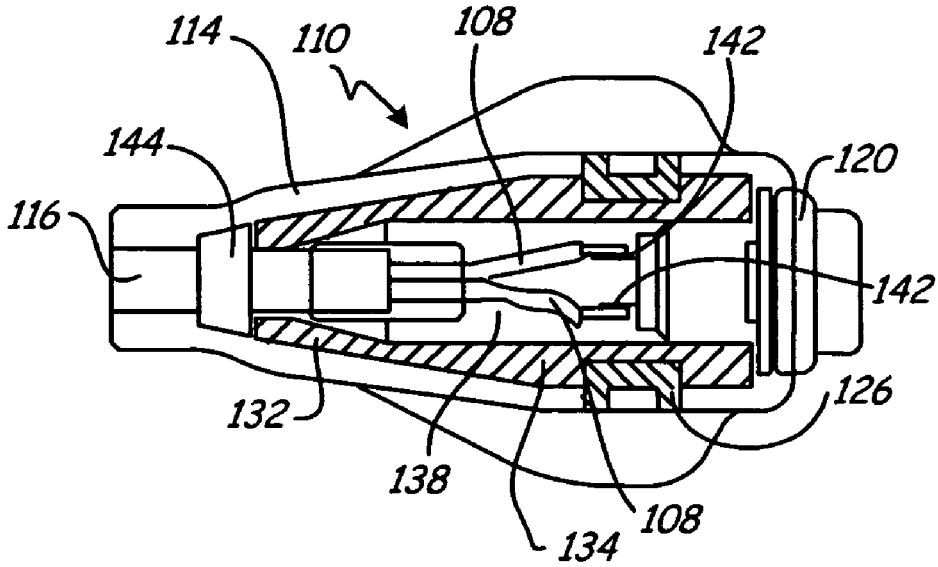
FIG. 4 is a cross-sectional view of the pendant portion.

FIG. 4 is a cross-sectional view of the pendant 110. Pendant 110 includes an inner housing assembly 132 having a cavity 138 extending lengthwise through the inner housing assembly. Switch 120 is positioned on one end of inner housing assembly 132 and, in one embodiment, extends into cavity 138. Cable 116 extends into an opposing end of the inner housing assembly 132. A grommet 144 is fitted over the cable 116 at the inner housing assembly 132 to provide a seal within the cavity 138.

Conductors 108 extend through the cable 116 and into the cavity 138. Each of the conductors 108 is adapted to be attached to one of a pair of terminals 142, which extend from switch 120. One of the conductors 108 illustratively supplies an electric signal to the switch and the other provides a return signal from the switch to the electrical plug 124. The conductors 108 can be attached to terminals 142 by, for example, soldering the conductors 108 and terminals 142 together. Alternatively, a connector (not shown) can be fixed to the end of each conductor 108. The connectors on each of the conductors 108 are illustratively configured to interface and be connected to the terminals 142.

Switch 120 is, in one embodiment, a single pole, single throw, normally open, momentary switch. Those skilled in the art will appreciate that other types of switches can be incorporated into a same or similar design without departing from the scope of the present invention. As just one example, a detented switch may be used. As another example, a normally closed switch may be used.

Inner housing assembly 132 is surrounded, in one embodiment, by an outer housing 114 which provides most of the outer surface 112 of the pendant 110. However, portions of the inner housing assembly 132 may extend through to the outer surface. For example, inner housing assembly 132 can include an inner housing portion 134 and an illumination member 126. Portions of the illumination member 126 illustratively extend through the outer housing 114 to support the illumination bands 122, which are shown in FIG. 3.

Figure 5:
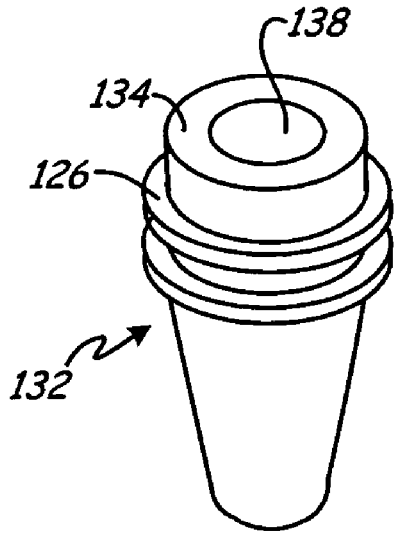
FIGS. 5, 6A and 6B are illustrations of portions of the pendant portion.
Figure 6A:
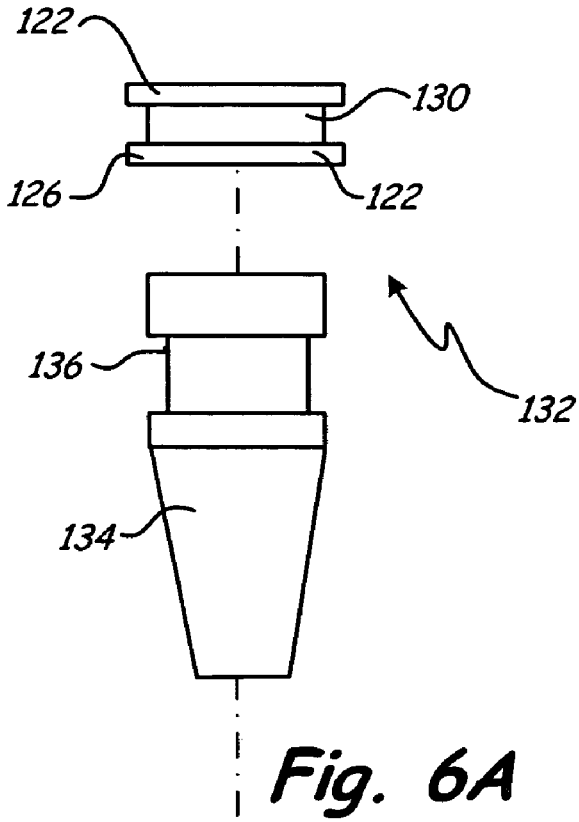

FIG. 6A is an exploded view of the inner housing assembly 132. Inner housing assembly 132 includes inner housing 134 and illumination member 126. Inner housing member 134 can be formed of a polycarbonate material or other suitable polymer. Inner housing member 134 is shaped to define a cavity 138 that extends from a first end to a second end of the inner housing member. Inner housing member 134 is shown having a notch 136, which is a region of reduced diameter on the inner housing 134. Illumination member 126 illustratively has an interior diameter to match that of the outer diameter of the notch 136. Thus, as is shown in FIG. 5, the illumination member 126 is fitted onto the inner housing member 134 such that it is positioned over the notch 136.

Illumination member 126 illustratively includes a pair of illumination bands 122, which extend from a receded portion 130 of an exterior surface of the illumination member 126. In one embodiment, not by limitation, illumination member 126 is formed from a polycarbonate material mixed with a photoluminescent pigment. In one embodiment, the pigment is a rare earth of alkaline earth-metal aluminate oxide doped with europium. Those skilled in the art will appreciate that other similar materials may be used without departing from the scope of the present invention.

In one embodiment, the material incorporated into illumination member 126 is selected such that, following exposure for a period of time to lighting such as, for example, fluorescent lighting or sunlight, the material will glow or illuminate with a green or blue color. Alternatively, phosphorescent material causing the illumination member 126 to glow or illuminate in any other color that is easily visible can be employed. Thus, a portion of the pendant is not electrically connected but will illuminate in the dark.

Figure 6B:
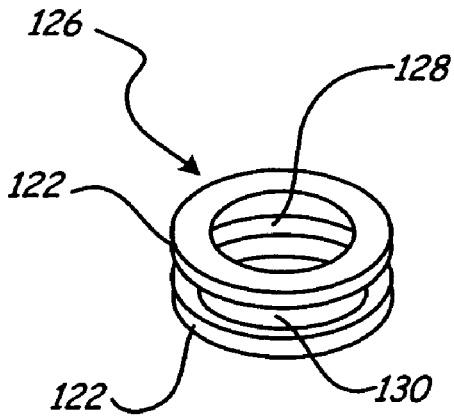

FIG. 6B shows an aperture 128, which extends through the illumination member 126. In one embodiment, the inner housing assembly 132 is formed by inserting the illumination member 126 into an injection mold. Then, the inner housing is injection molded into the aperture 128 so that the illumination member 126 and the inner housing 134 are integrally formed together. Alternatively, the entire inner housing assembly 132 can be formed of a single material. For example, the inner housing assembly 132 can be injection molded from the same material previously described as forming the illumination member 126. Alternatively still, the inner housing assembly 132 can be inserted into an injection mold and the illumination member 126 can be molded over the inner housing assembly 132.

Once the inner housing assembly 132 is formed, cable 116 can be inserted into the cavity 138 of the inner housing assembly 132 and connected to switch 120. After the cable 116 and switch 120 have been attached and properly positioned within the cavity 138 of the inner housing assembly 132, housing 114 can be overmolded onto the inner housing assembly 132 to provide the outer surface of the pendant 112. The housing 114, in one embodiment is formed from a polymer material having a suitable hardness to withstand the normal uses of the call switch assembly 40. The overmolding process is performed to provide a cavity in the housing to allow portions of the inner housing 134 to protrude through the housing 114 and provide illumination areas such as illumination bands 122.

It has been found that when call device 40 is constructed with the materials noted herein (to which the present invention is not necessarily limited) is exposed to light (e.g., fluorescent light) for a period of two hours, it will have absorbed enough energy to cause the illumination bands to provide a glowing for up to four hours in total darkness. Thus, the call switch assembly 40 or any other device similarly configured with illumination material is more easily discovered by a patient requiring assistance in a low or no light environment than would otherwise be the case.

The described incorporation of non-electrical luminescent material into a medical device is not limited to application in the context of a call button device.

Figure 7:
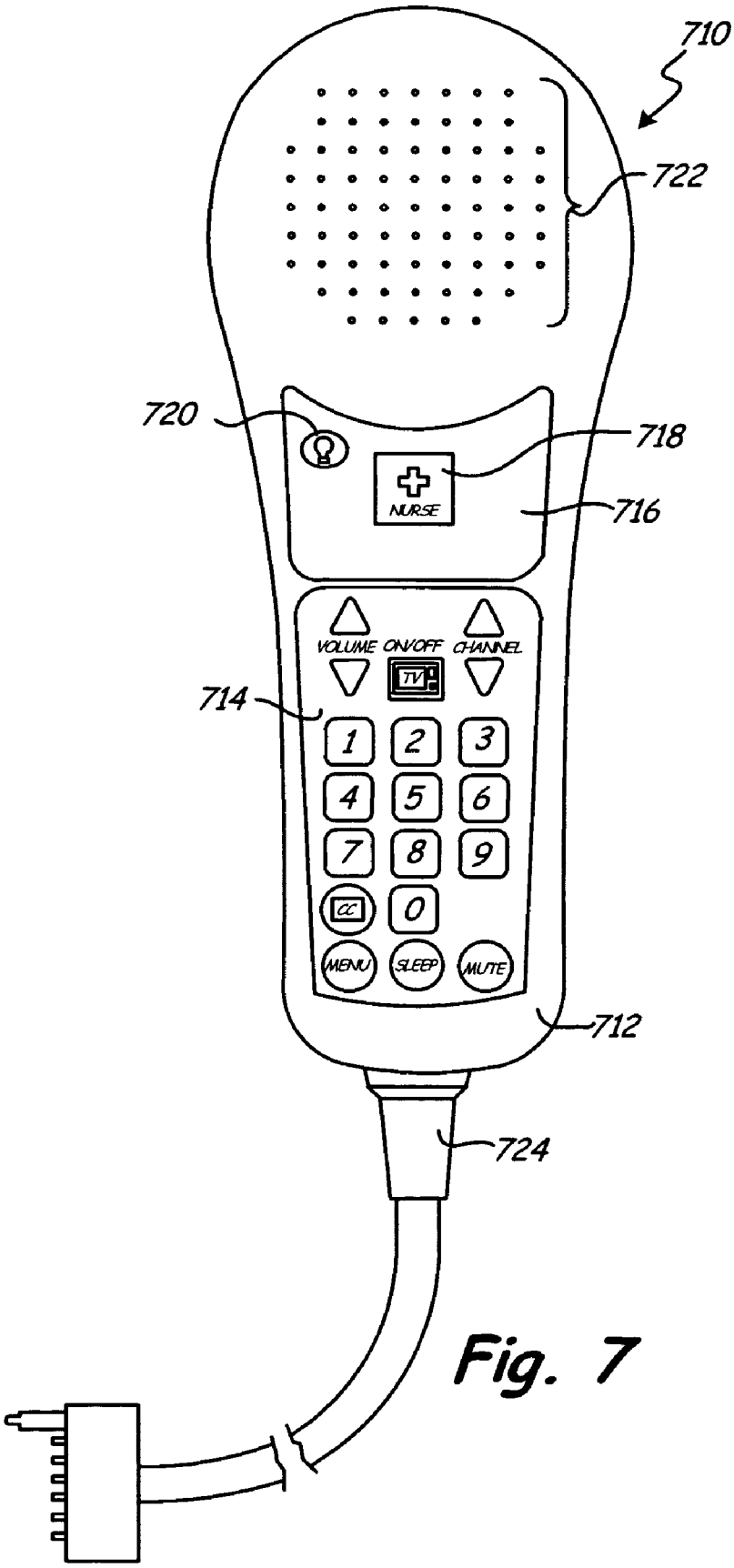
FIG. 7 is a front panel view of a pillow speaker.

FIG. 7 is a front panel depiction of a pillow speaker device 710. Device 710 includes a control panel 716 having a nurse call button 718. Button 718 can be pressed to activate a call system in a manner similar to the call button embodiments. Also similar to the call button embodiments, device 710 includes a cord 724 that houses at least one elongated conductor connected to a plug that interfaces into a control system.

In contrast to the call button embodiments, pillow speaker device 710 includes a broader range of control buttons that are connected to enable the transmission of corresponding signals through the associated connector to the control system. For example, device 710 includes a lighting control button 720 and television control buttons 714. The buttons associated with device 710 are presented on a front surface 712 of the device. Device 710 also includes at least one internal speaker that is configured to broadcast sound through speaker holes 722.

In embodiment, luminescent material can be incorporated into any portion of pillow speaker 710 to enable greater device visibility in darker environments without reliance on electrical power. In one embodiment, all or a portion of the panel around one or more buttons incorporates the luminescent material. In another embodiment, all or a portion of one or more buttons themselves incorporate the luminescent material. In one embodiment, at least one button is a membrane-type button having an external surface constructed of a material that incorporates luminescent material. The concept of a membrane-type button that is configured to glow in the dark is within the scope of the present invention.

Although the above description is represented in specific embodiments, workers skilled in the art will appreciate that modifications can be made to the embodiments without departing from the scope of the invention.

What is claimed is:

1. A call button device, comprising:

an electrical connector in electrical communication with an elongated electrical conductor;

a cable housing at least a portion of the elongated conductor; and a pendant member having an elongated body with first and second ends located on opposing ends of the elongated body, the pendant member including an actuable switch that is in electrical communication with the electrical connector through the elongated conductor, the pendant member also including a luminous portion that provides non-electrical illumination, wherein the actuable switch is located at the first end of the pendant member and the elongated conductor is located at the second end of the pendant member, wherein the luminous portion at least partially surrounds the elongated body, and wherein the luminous portion comprises at least one band.

2. The call button device of claim 1, wherein the luminous portion comprises two or more bands.

3. The call button device of claim 1, wherein the electrical conductor interfaces with an alert system, and wherein actuation and deactivation of the actuable switch causes corresponding electrical signals to be communicated through the elongated electrical conductor and the electrical connector.

4. The call button device of claim 1, wherein the elongated conductor comprises multiple elongated conductors.

5. The call button device of claim 1, further comprising:

a clip releasably connected to the cable.

6. The call button device of claim 1, wherein the actuable switch is a single pole, single throw, normally open, momentary switch.

7. The call button device of claim 1, wherein the actuable switch is a detented switch.

8. The call button device of claim 1, wherein the pendant member comprises a polycarbonate material.

9. The call button device of claim 1, wherein the luminous portion comprises a polycarbonate material mixed with a photoluminescent pigment.

10. The call button device of claim 9, wherein the photoluminescent pigment comprises aluminate oxide doped with europium.

11. A call button device, comprising:

an inner housing assembly having first and second ends and a cavity that extends lengthwise through the inner housing assembly;

an outer housing assembly that surrounds the inner housing assembly;

a non-electrical illumination member that fits around a notch of the inner housing assembly and that extends through the outer housing assembly;

a switch located at the first end of the inner housing assembly; and a cable that is inserted into the cavity through the second end of the inner housing assembly and that communicatively couples the switch to an alert system such that actuation and deactivation of the switch causes corresponding electrical signals to be communicated through the cable to the alert system.

12. The call button device of claim 11, wherein the non-electrical illumination member is located between the first and the second ends of the inner housing assembly.

13. The call button device of claim 11, and further comprising:

a grommet that is fitted over the cable at the inner housing assembly and that provides a seal within the cavity.

14. The call button device of claim 11, wherein the non-electrical illumination member comprises a phosphorescent material.

15. The call button device of claim 11, wherein the non-electrical illumination member comprises a polycarbonate material mixed with a photoluminescent pigment.

16. The call button device of claim 15, wherein the photoluminescent pigment comprises aluminate oxide doped with europium.

17. The call button device of claim 11, wherein the switch is a single pole, single throw, normally open, momentary switch.

18. The call button device of claim 11, wherein the switch is a detented switch.

19. The call button device of claim 11, and further comprising:

a clip releasably connected to the cable.

20. The call button device of claim 11, wherein the cable includes multiple elongated conductors.

* * * * *